United States Patent [19]

Rotolico

[11] Patent Number: 4,519,541

[45] Date of Patent: May 28, 1985

[54] TORCH FLAME SPRAY SYSTEM

[75] Inventor: Anthony J. Rotolico, Hauppauge, N.Y.

[73] Assignee: Eutectic Corporation, Flushing, N.Y.

[21] Appl. No.: 439,813

[22] Filed: Nov. 8, 1982

[51] Int. Cl.[3] ..... B05B 17/00

[52] U.S. Cl. ..... 239/1; 239/85

[58] Field of Search ..... 239/413, 590, 1, 79, 239/85; 138/40, 44

[56] References Cited

U.S. PATENT DOCUMENTS

| | | | |
|---|---|---|---|
| 3,409,382 | 11/1968 | Voorheis | 138/40 X |
| 3,620,454 | 11/1971 | Broderick et al. | 239/79 |
| 3,995,811 | 12/1976 | Broderick et al. | 239/85 |
| 4,420,009 | 12/1983 | Sharp et al. | 138/44 X |

*Primary Examiner*—Andres Kashnikow
*Assistant Examiner*—James R. Moon, Jr.
*Attorney, Agent, or Firm*—Hopgood, Calimafde, Kalil, Blaustein & Judlowe

[57] ABSTRACT

A flame spray system comprising a torch is provided having a gas mixing chamber and means for feeding acetylene and oxygen to the mixing chamber in a preselected proportion. The system includes acetylene valve means with an orifice restrictor for feeding the gas to a mixing chamber, the orifice size being selected to provide, in the choked state, a flow of acetylene therethrough under a selected choke pressure. Oxygen valve means is also provided with an orifice restrictor of size selected to provide in the choked state a flow of oxygen therethrough under a selected choke pressure, the ratio of oxygen flow rate to the acetylene flow rate under the selected pressures to the orifices being such that an increase in pressure for the selected orifice sizes does not substantially change the flow characteristics out of the orifices in the choked state as compared to a decrease in gas pressure to below choke conditions which results in an adverse change in flame characteristics, the flow of the gases through the orifices in the choked state into the mixing chamber resulting in optimum flame chemistry as measured in terms of optimum BTU's per hour.

2 Claims, 5 Drawing Figures

TORCH FLAME SPRAY SYSTEM

This invention relates to a torch flame spray system and, in particular, to a flame spray torch having controlled sized orifices predetermined to provide proper flame chemistry and BTU output.

STATE OF THE ART

In U.S. Pat. No. 3,620,454, a gravity feed flame spray torch is disclosed having nozzle means through which a gas mixture is fed to provide a high velocity flame of high temperature to which is externally fed powder material as the flame issues from the nozzle. In order to achieve the desired flame characteristics, adjustable gas flow valves are provided, which valves are manipulated according to the gas pressures employed. To maintain the desired flame characteristics, generally complex monitoring devices are employed together with operator judgement as to the condition of the flame.

It would be desirable to provide a flame spray torch system having gas orifices critically sized such that for specified gas pressures of each of the gases, i.e., acetylene and oxygen, fed to the gas mixing chamber, controlled stoichiometric gas balance and BTU output are assured without requiring continual adjustment of the gas valves.

The invention will more clearly appear when taken in conjunction with the following description, the claims, and the accompanying drawing, wherein:

STATEMENT OF THE INVENTION

One embodiment of the invention is directed to a flame spray system comprising a torch having a gas mixing chamber and means for feeding acetylene and oxygen to said mixing chamber in a preselected proportion for providing optimum BTU output, the system comprising, an acetylene gas flow orifice leading to the mixing chamber, the size of the orifice being restricted and selected to provide in the choked state a flow of acetylene therethrough under selected pressure, and an oxygen flow orifice likewise restricted and sized to provide in the choked state a flow of oxygen therethrough under selected pressure.

The ratio of oxygen flow to the acetylene flow at the selected pressures is such that an increase in pressure for the selected orifice sizes does not change the flow characteristics out of the orifice into the mixing chamber in the choked state as compared to a decrease in pressure below the choked state which results in an adverse change in flame characteristics. The flow of the gases through the orifices in the choked state into the mixing chamber at predetermined pressures provides optimum flame chemistry as measured in terms of optimum BTU's per hour.

Thus, the flame spray torch employs, in addition to reverse flow or check valves located at the rear of the torch, two critically sized orifices which are disposed within adaptors coupled to the check valves and become an integral part of the valve system. The functioning of the orifices is such that at a prescribed pressure for each of oxygen and fuel gas, a predetermined amount of flow of each of the gases at a predetermined ratio will flow into the mixing chamber and out through the nozzle, which following ignition results in a controlled stoichiometric gas balance and BTU output. If the gases become unbalanced within a specific tolerance range, the flame on the torch tip can be visually observed as being out of adjustment which can be easily corrected by raising the pressure to the restricted orifices.

By employing the orifices in the choked state relative to the gas flow therethrough, an increase in pressure does not change the gas flow relationship out of the orifices.

DETAILS OF THE INVENTION

The orifices within the valve assembly are employed as restrictors to gas flow such that a uniform flow of gases is assured at a specified minimum pressure, the pressure of the gases flowing through the orifices being generally at above the minimum pressure.

Choking is defined as that maximum quantity of fluid that passes through a sized orifice at or above a specified pressure, which pressure is defined as the choking pressure.

Figure 1:
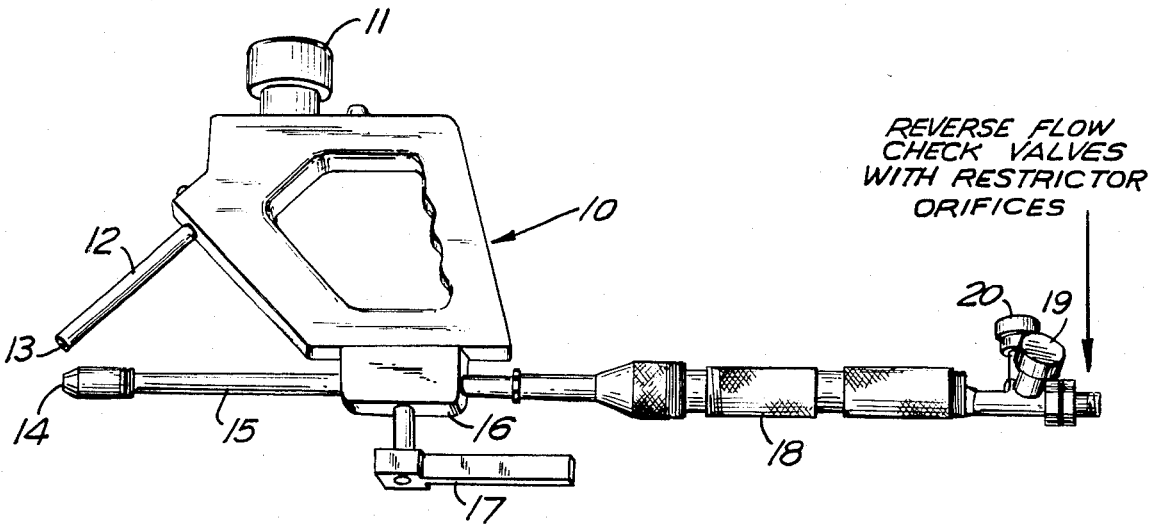
FIG. 1 is illustrative of one embodiment of a complete torch assembly in accordance with the invention.

Referring to FIG. 1, the torch assembly is shown comprising a polygonal frame 10 with a powder receptacle 11 coupled to the upper portion thereof in powder feeding relationship with external feed tube 12 with the end 13 thereof extending to the proximity of nozzle 14. The nozzle is part of the forward flame assembly 15 which extends rearwardly of the nozzle through support 16 at the base of frame 10 to which is coupled tool post holder or block 17 for supporting the torch assembly relative to a workpiece to be flame sprayed.

The flame assembly 15 coaxially extends into handle 18 which has a gas-mixing chamber disposed forward thereof. Coupled to the handle are two on-off oxygen-acetylene valves 19, 20 having disposed rearward thereof two check valves with two orifice restrictors which more clearly appear in FIG. 3.

Figure 2:
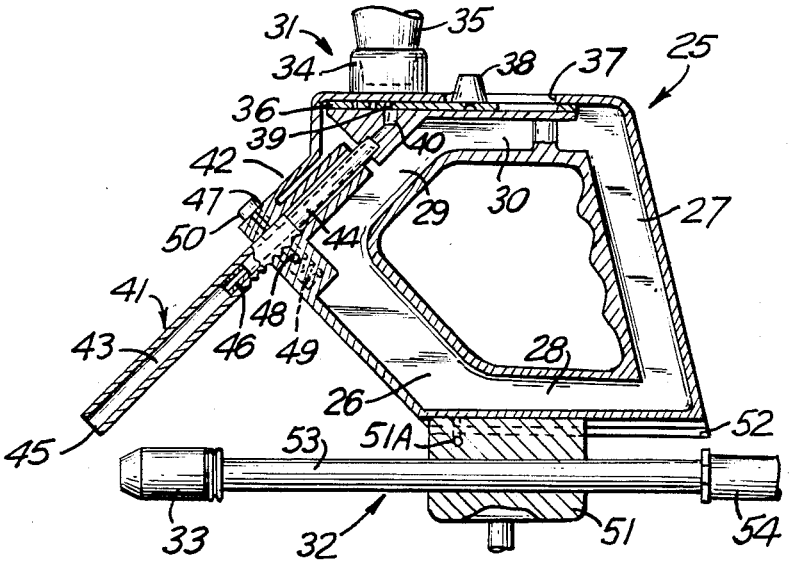
FIG. 2 is a detailed rendition of the gas torch frame shown in FIG. 1.

A more detailed rendition of the torch frame is shown in FIG. 2. The torch frame 25 is adapted for the external gravity feed of metal powder directly to the flame issuing from the nozzle.

The torch has a housing in the shape of a five-sided polygon with one leg of the polygon arranged as a handle portion 27, another leg as a base portion 28, a further leg as a feed portion 29, and another leg of the polygon as the top portion of the torch. The housing 26 has coupled to it a powder feed assembly 31 and a flame assembly 32 to which is coupled nozzle 33.

The top portion 30 is provided with a fitting 34 adapted to receive a receptacle 35 (shown fragmentarily) for holding the alloy powder, a metering device being employed to control powder feed comprising a feed actuator plate 36 slidably mounted in a slot 37 located in the housing top portion 30 below fitting 34. Feed plate 36 is provided with a knob 38 which protrudes upwardly above the housing and permits the sliding of feed plate 36 reciprocally toward and away from housing feed portion 29.

The powder flows by gravity unhindered through circular orifices which may range in size from 0.075 to 0.120 inch for different powders, the flow being maintained substantially constant over a mesh size range of minus 100 to plus 325 mesh.

In achieving the desired flow rate, feed plate 36 is selectively aligned with powder flow orifice 39 to control variably the flow rate of the powder from receptacle 35 through flow orifice 39 through conduit 40 and through variable spray control assembly 41. Assembly 41 has a housing 42 which holds a powder feed tube 43 and having a central core hollow cylinder 44 slidably and telescopically fitted within feed tube 43 and communicating directly with powder conduit 40 to deliver powder directly by gravity to feed tube 43, the powder then flowing through discharge end 45. A portion of the outer surface of feed tube 43 is provided with indexing means for grooves 46 which through latching assembly 47 enables the setting of powder feed tube 43 in order to locate discharge end 45 at the correct distance from the flame end of nozzle 33. The latching assembly comprises a holding pin 48 that is normally urged toward one of the indexing grooves 46 by spring 49, the holding pin 48 being actuated by rod 50 in making the setting. Thus, by depressing rod 50, the pin is moved out of contact with one of the indexing grooves and tube 43 set according to the desired position.

The flame assembly 32 is supported by sliding element 51 which can be lockingly moved along a track 52 located at the bottom leg of housing 26, a locking pin 51A being provided as shown. Gas flow tube 53 is fixedly held by sliding element 51 and may be factory set, one end of the tube having a connector 54 for attaching to a source of oxygen and acetylene.

The powder flows down tube 43 and is discharged at 45 into the flame issuing from nozzle 43. The powder is sprayed on a metal substrate, e.g., a steel shaft, at about six to eight inches from the workpiece.

Figure 3:
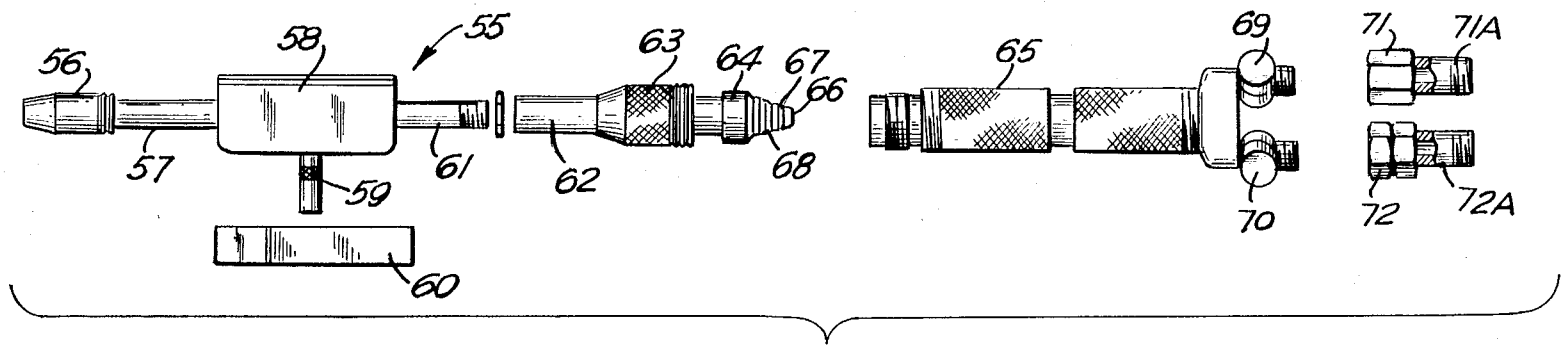
FIG. 3 depicts an exploded view of the torch nozzle, torch handle and the gas valves coupled thereto.

In FIG. 3, the flame assembly segment is designated generally by the numeral 55 comprising nozzle 56 and nozzle tube 57 which passes through mounting block 58 having a tool support 59 which is cooperably mountable to tool support holder 60 when in use. The nozzle tube terminates as a threaded nipple 61 which is coupled to gas mixer 62 which via nut 63 and extension 64 is coupled to torch handle assembly 65, the extension 64 having a reduced conical portion 66 with "O"-rings 67, 68 to provide a sealed attachment to the handle assembly.

Handle assembly 65 has two on-off gas valves 69, 70 to which are coupled oxygen and acetylene gas check valves 71 and 72 with orifice restrictors 71A, 72A, respectively.

As illustrative of one embodiment of the invention, the following example is given:

EXAMPLE

Gas restrictors of the following sizes were employed:

| | |
|---|---|
| Oxygen | 0.0472 ± 0.005" diam. |
| Acetylene | 0.0520 ± 0.005" diam. |

Operating Parameters

| GAS | PRESSURE | FLOW METER READING | SCFH |
|---|---|---|---|
| Oxygen | 20 psi | 30 | 48 |

-continued

| GAS | PRESSURE | FLOW METER READING | SCFH |
|---|---|---|---|
| Acetylene | 8 psi | 50 | 36 |

Gas Ratio $O_2/C_2H_2 = 48/36 = 1.33/1$

Thermal Energy

1440 BTU/ft$^3$ (36 ft$^3$/hr.) = 51,840 BTU/hr.

As stated hereinbefore, the restrictors located in the flow valves will permit a specified quantity of gas to flow at a designated pressure. By sizing the restrictors properly, the total flow delivered to the system will be in the choked state. In this state, an increase in pressure will not change the flow conditions at the nozzle. A reduction in pressure to below the minimum choking pressure changes the flow characteristics and modifies the gas balance which is easily detectable by the appearance in the flame.

By fixing the size of the orifices in accordance with the flame chemistry desired, complicated monitoring of the torch is avoided. The fixed sized orifices assures maintaining the desired thermal capacity of the torch which, together with the proper gas mixture and controlled powder delivery, results in a system having the proper flame temperature, flame chemistry and heat (BTU/hr.) to handle the specified amount of powder delivered to the flame.

In setting the torch for a particular use, the sized orifices employed are determined as follows: (1) Select the BTU output desired; (2) Decide if the flame is to be neutral, slightly oxidizing, or slightly reducing; (3) Determine the pressures of acetylene and oxygen to provide the flow rates to produce the selected BTU's; (4) Try the particular sized orifices to give the results desired. If the results are not exactly as desired, the size of orifices is recalculated to give the results.

Once the sizes of the orifices have been determined, the use of the torch is greatly simplified and requires very little adjustment so long as the orifices are used in the choked state relative to the gas pressures at the orifices.

Referring to the Example hereinbefore, it will be noted that the gas flow ratio of $O_2/C_2H_2$ is determined as 1.33/1. Theoretically, for substantially complete combustion, the ratio of $O_2/C_2H_2$ is about 2.5/1. However, depending on the nozzle design and the atmospheric conditions at the nozzle, the amount of oxygen actually used in the gas mixture is less than theoretical due to aspiration of air into and along the flame at the exit end of the nozzle, the aspirated air taking part in the combustion.

For the torch of the type shown in FIG. 2, the $O_2/C_2H_2$ ratio at gas pressures of 20 psi and 8 psi, respectively, may range from about 1.3 to 1.5.

An additional embodiment of the invention resides in a method for operating a flame spray system comprising a torch assembly having a gas mixing chamber and valve means for feeding fuel gas and valve means for feeding oxygen to said mixing chamber in a preselected proportion. The improvement comprises providing each of the valve means with an orifice restrictor of size predetermined to pass through gas at a predetermined choked state, passing fuel gas and oxygen, respectively, through the orifice restrictors at an oxygen/fuel-gas flow ratio and pressures corresponding to optimum BTU capacity calculated in terms of BTU's per hour with the pressures maintained in excess of minimum choking pressure for each of the restrictors, and maintaining the choking condition of the gas flow through each of the orifice restrictors during thermal operation of said flame spray system by simply increasing the pressures to above minimum choking pressure based on observation of the flame conditions without substantially changing the predetermined flow of gases through the restrictors during operation of the flame spray system. Generally speaking, the pressure is maintained at an excess of up to about 15% of the pressure at which choking occurs for a particular sized restrictor.

The invention is applicable to flame spray torches of various nozzle designs, such as the conically shaped nozzle 56 shown in FIG. 3. In this connection, reference is made to the conically shaped nozzle disclosed in U.S. Pat. No. 3,995,811, the disclosure of which is incorporated herein by reference. This particular embodiment is represented by FIGS. 4 and 5 of the drawings herein.

Figure 5:
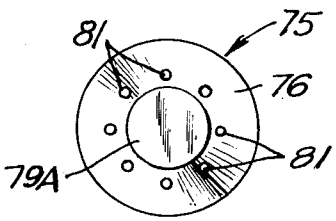
FIG. 5 is an end view of the nozzle of FIG. 4.
Figure 4:
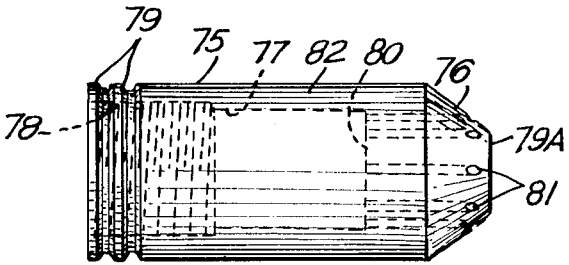
FIG. 4 is an enlarged view of a conically shaped nozzle.

Referring to FIGS. 4 and 5, a hollow nozzle 75 with a thick wall 82 is shown having a tapered nose 76 as shown, said nozzle having an inner bore 77 located axially therein which communicates with and defines a gas chamber with an outer bore 78 of slightly larger diameter which is connectable to a stem (note 57 of FIG. 3) through which the gas mixture is fed into nozzle 75. The nozzle which is preferably made of tellurium copper has a series of annular grooves or fins 79 at the coupling end thereof to serve as cooling radiators to control the temperature of the nozzle.

The tapered nose 76 terminates into a tip 79A which constitutes a flat circular face as shown. The end wall 80 of the bore including tapered nose 76 is fairly thick relative to the size of the nozzle and it is through this end wall and the tapered nose that gas-conducting orifices 81 are substantially axially formed. The thick end wall also behaves as a heat sink in conducting heat away from the tip of the nozzle. The plurality of gas-conducting orifices is disposed radially or conically about the axis of the nozzle and passes through the conical surface just short of tip 79A, the orifices forming elliptical openings on the conical surface. In the end view shown in FIG. 5 looking towards the tip end 79A, it will be noted that the orifices emerging from the conical surface of the nose of the nozzle lie substantially in a circle.

Thus, when an oxyacetylene gas mixture enters the gas chamber defined by bores 77 and 78 and passes through the orifices and is ignited as shown, a plurality of uniform jets is formed, each jet having an inner cone of unburned gas and an outer cone having a bluish color. By having the jets emit from the inclined face of the nose rather than directly from the tip as is the practice, a more stable flame is provided which is not extinguished when the tip 79A of the nose of the nozzle touches an interfering surface, since the orifices are back of the tip. It is also believed that the conical surface provides a more streamlining effect of the air aspirated along flame edges.

The aspiration of air along the flame becomes part of the combustion mixture such that the amount of oxygen fed to the torch together with the fuel gas is less with respect to the oxygen/fuel ratio which in the Example set forth hereinbefore is about 1.3/1, the theoretical amount being about 2.5/1. The flame which is blue in color when the balance is right and is very sensitive to change should the gas pressures (oxygen and fuel gas pressures) fall below the minimum choking pressure for each of the orifice restrictors in the flame spray system. When there is a change in flame characteristics as evidenced by the change in color, length and number of flame zones, the operator need only to increase the pressure to the choking pressure to bring the flame back to its predetermined condition.

A person skilled in the art of oxyacetylene welding is familiar with flame characteristics and knows how to obtain the particular flame characteristic for his purposes. The approach in obtaining a particular flame is standard procedure. For example, a flame that issues from the tip of the torch nozzle has an inner cone or vivid blue flame of the burning mixture of gases which is called the working flame. The closer the end of the flame's inner cone is to the surface of the metal being welded, the more effective is the heat transfer from flame to metal. The kind of flame desired can be obtained by changing the ratio of the volume of oxygen to acetylene issuing from the tip of the nozzle. Most welding is done with a neutral flame having approximately a 1:1 gas ratio. If an oxidizing action is desired, this is obtained by increasing the oxygen flow; and conversely, if a reducing action is desired, this is obtained by increasing the acetylene flow. Substantially complete combustion is obtained when the flame is neutral, although a slightly oxidizing flame is preferred. In the case of a neutral flame, there are two zones with a fairly long inner blue cone. In the case where excess oxygen is employed, the flame has two zones in which the inner blue cone is shorter than in the neutral flame. In the case of excess acetylene, there are three zones in which there is a sharply defined inner cone and a bluish outer envelope, except that between these two zones there is an intermediate cone of whitish color.

Once an operator has decided on a flame characteristic that gives optimum BTU output, any variation from that particular flame characteristic is easily corrected by increasing the pressure to above the choking pressure to bring the flame back to its predetermined characteristic. Thus, the use of choking orifices overcomes the necessity of employing complicated valve manipulation normally employed when using standard gas valves.

Although the present invention has been described in conjunction with preferred embodiments, it is to be understood that modifications and variations thereto may be resorted to without departing from the spirit and scope of the invention as those skilled in the art will readily understand. Such modifications and variations are considered to be within the purview and scope of the invention and the appended claims.

What is claimed is:

1. In a method for operating a flame spray system comprising a torch assembly having a gas mixing chamber and valve means for feeding fuel gas and valve means for feeding oxygen to said mixing chamber in a preselected proportion; the improvement which comprises, providing each of said valve means with an orifice restrictor of size predetermined to pass through gas at a predetermined choked state, passing fuel gas and oxygen, respectively, through said orifice restrictors at an oxygen/fuel-gas flow ratio and pressures corresponding to optimum BTU capacity for a particular flame characteristic calculated in terms of BTU's per hour with the pressures maintained in excess of minimum choking pressure for each of said restrictors, said flame characteristic being one selected from the group consisting of (a) a slightly oxidizing flame, (b) a neutral flame and (c) a slightly reducing flame, and maintaining the excess choking pressure of the gas flow through each of the orifice restrictors during thermal operation of said flame spray system in accordance with the flame conditions observed during operation of said flame spray system without substantially changing the predetermined flame chemistry of said flame spray system during operation thereof.

2. In a method for operating a flame spray system comprising a torch assembly having a gas mixture chamber and valve means for feeding fuel gas and valve means for feeding oxygen to said mixing chamber in a preselected proportion, said torch assembly including means for feeding flame spray powder to be sprayed and a nozzle comprised of a hollow cylindrical body defining a gas chamber and having a converging conically shaped nose terminating into a closed tip, a plurality of gas-conducting orifices communicating with the gas chamber of said nozzle and passing through the nose of said nozzle substantially coaxial with the axis of said nozzle and emerging from the conical surface thereof short of the tip, said orifices being disposed radially about the axis of said nozzle and lying in a circle on said conical surface adjacent the tip when observed from the tip end of said nozzle, the improvement which comprises, providing each of said valve means with an orifice restrictor of size predetermined to pass through gas at a predetermined choked state, passing fuel gas and oxygen, respectively, through said orifice restrictors at an oxygen/fuel-gas flow ratio and pressures corresponding to optimum BTU capacity for a particular flame characteristic calculated in terms of BTU's per hour with the pressures maintained in excess of minimum choking pressures for each of said restrictors, said flame characteristic being one selected from the group consisting of (a) a slightly oxidizing flame, (b) a neutral flame and (c) a slightly reducing flame, and maintaining the excess choking pressure of the gas flow through each of the orifice restrictors during thermal operation of said flame spray system in accordance with the flame conditions observed during operation of said flame spray system without substantially changing the predetermined flame chemistry of said flame spray system during operation thereof.

* * * * *